US006693266B1

(12) United States Patent
Yagi

(10) Patent No.: US 6,693,266 B1
(45) Date of Patent: Feb. 17, 2004

(54) MICROWAVE HEATING APPARATUS AND METHOD OF HEATING OBJECTS

(76) Inventor: Shunichi Yagi, 2-5-19, Shida, Fujieda-shi, Shizuoka-ken 426-0071 (JP)

( * ) Notice: Subject to any disclaimer, the term of this patent is extended or adjusted under 35 U.S.C. 154(b) by 0 days.

(21) Appl. No.: 09/677,987

(22) Filed: Oct. 3, 2000

(51) Int. Cl.[7] ..... H05B 6/72

(52) U.S. Cl. ..... 219/695; 219/697; 219/748; 219/750

(58) Field of Search ..... 219/748, 746, 219/747, 749, 745, 695, 696, 697, 750; 333/230, 227, 228, 253, 254

(56) References Cited

U.S. PATENT DOCUMENTS 4,496,814 A * 1/1985 Fitzmayer ..... 219/749
4,752,663 A * 6/1988 Meisel ..... 219/746
5,417,941 A * 5/1995 McNulty ..... 219/696
5,786,579 A * 7/1998 Park ..... 219/746
6,246,039 B1 * 6/2001 Omori et al. ..... 219/746

FOREIGN PATENT DOCUMENTS

EP 0 014 121 * 8/1980 ..... 219/697

* cited by examiner

*Primary Examiner*—Philip H. Leung
(74) *Attorney, Agent, or Firm*—Hedman & Costigan, P.C.

(57) ABSTRACT

In order to reduce reflected waves and improve heating matching, a microwave heating apparatus is equipped with at least one cone-shaped, bell-shaped, pyramid-shaped or similarly shaped waveguide, a reflector apparatus provided inside the waveguide, and a reflection diffusion apparatus provided inside the oven.

5 Claims, 9 Drawing Sheets

MICROWAVE HEATING APPARATUS AND METHOD OF HEATING OBJECTS

BACKGROUND OF THE INVENTION

1. Field of the Invention

The present invention is related to a heating apparatus and a method of heating objects inside an oven using microwaves in order to carry out drying, warming, thawing, cooking, roasting, sterilizing, concentrating and the like.

2. Description of the Prior Art

In the case were objects are heated using microwaves, when microwaves emitted from a magnetron are passed through a waveguide and introduced inside a tank, a portion of such introduced microwaves form reflected waves which travel in the opposite direction and return to the magnetron, thereby creating an energy loss and damaging the magnetron due to the heat generated by such reflected microwaves. Prior art technology for preventing this includes mounting a matching device midway in the waveguide to match the microwaves in order to reduce reflected waves, and mounting an isolator near the microwave generator to absorb and eliminate reflected waves.

Further, a stirrer is generally mounted inside the oven to disperse the microwaves in order to achieve matching.

Further, in the case where a plurality of microwave introduction ports are provided in the oven, these microwave introduction ports are arranged away from mutually opposing positions to prevent increased reflected waves and mutual interference of the microwaves introduced through such introduction ports, and in the case of rectangular microwave introduction ports, if a horizontal arrangement is used on one side, a vertical arrangement can be used on the opposite side away from opposing positions.

However, the isolator and matching device used in the prior art are extremely expensive and form the main cause of high costs introduced when the microwave generator is to be used a lot for industrial applications, and for this reason the use of such high value-added energy microwaves has been limited.

Further, a stirrer is generally provided to disperse the microwaves inside the oven in order to achieve uniform heating, but because this requires a significant mounting space for holding the rotation axle for the rotor and the motor required for the stirrer, it is impossible to provide a large number of microwave introduction ports, and this makes it difficult to achieve uniform heating by means of a plurality of microwave introduction ports. Further, because the incident waves interfere with each other and become dispersed while the stirrer is rotating, a fluctuating increase and decrease in reflected waves normally appears, and this has made it difficult to achieve a stable reduction in reflected waves.

Further, in the case where a plurality of microwave introduction ports are provided in the oven, when these microwave introduction ports are arranged at positions away from opposing positions, minute changes in position can have subtle adverse effects on uniform heating and matching, and this has created problems for heating matching and made it impossible to achieve a sufficient reduction in reflected waves. In particular, this problem is striking in the case where the object being heated is fixed in place.

SUMMARY OF THE INVENTION

First, the waveguide connected to the oven is shaped so to not hinder the propagation of microwaves incident toward the oven, namely, the waveguide is shaped so that the cross-sectional area of the port portion of the waveguide at the oven side is greater than the cross-sectional area at the microwave generator side. Namely, the cross-sectional area of the waveguide gradually expands from the microwave generator side toward the oven side to give the waveguide a horn shape, and a prescribed size cone-shaped, pyramid-shaped, bell-shaped or other similarly shaped reflector apparatus is provided at a prescribed position inside the waveguide with the bottom of the reflector apparatus facing the oven side to form a structure which does not hinder the propagation of incident microwaves from the microwave generator toward the oven. With this structure, most of the reflected microwaves heading toward the waveguide from the oven will be reflected again by the bottom of the reflector apparatus and returned to the inside of the oven, and this significantly reduces the reflected microwaves traveling back toward the microwave generator.

Further, if a straight tube made of metal is provided between the waveguide and the microwave introduction port of the oven, the incident microwaves passing through the straight tube will make it possible to improve the heating matching, and this further reduces the reflected microwaves. In this case, the straight tube has a prescribed length and both ports thereof have the same size and shape as the oven-side port portion of the waveguide.

Next, if the stirrer of the prior art is replaced with a fixed metal reflection diffusion apparatus provided in the oven at a position in front of the microwave introduction port of the oven at a prescribed distance from the microwave introduction port, the microwaves incident into the oven will undergo reflection diffusion, and this makes it possible to achieve highly uniform heating. Also, the use of an appropriately sized reflection diffusion apparatus at an appropriate position facilitates heating matching and reduces reflected waves. Further, because the reflection diffusion apparatus is compact, the use thereof makes it possible to provide many microwave introduction ports, thereby making it possible to improve heating matching. Moreover, the use of the reflection diffusion apparatus prevents the reflected energy fluctuations that occur for the rotational dispersion carried out by a stirrer, and this contributes to reducing reflected waves.

Further, by providing the oven with a plurality of microwave introduction ports arranged at opposing positions, it is possible to carry out fine matching and achieve highly accurate uniform heating. In the case where the microwave introduction ports are arranged at opposing positions, because the microwaves propagate toward opposing microwave introduction portions, there is generally an increase in reflected waves which results in a loss of heating matching. However, this problem is eliminated by the waveguide provided with a reflector apparatus, and the reflection diffusion apparatus, which make is possible to significantly reduce reflected waves and significantly improve heating matching.

Namely, the method of heating objects with microwaves according to the present invention involves passing microwaves emitted from a microwave generator toward an oven through a propagation path shaped so as to not hinder the propagation of microwaves incident toward the oven, and shaped so to make the cross-sectional area of the oven side port portion of the propagation path larger than the cross-sectional area of the microwave generator side port portion of the propagation path, with a microwave reflector apparatus being provided at a prescribed position inside the propagation path to reflect most of the reflected microwaves from the oven heading toward the microwave generator back into the oven in order to reduce reflected waves and facilitate heating matching.

Further, the microwave heating method may further comprise the step of passing the microwaves incident toward the oven through a straight metal tube having a prescribed length and port portions having the same size and shape as the oven side port portion of the propagation path in order to reduce reflected waves and facilitate heating matching.

Another method of heating objects with microwaves according to the present invention involves passing microwaves emitted from a microwave generator through a microwave introduction port into an oven provided with a metal reflection diffusion apparatus arranged at a prescribed position in front of the microwave introduction port at a prescribed distance therefrom, whereby a prescribed ratio of the microwaves incident into the oven undergo reflection diffusion, wherein the major portion of the reflection diffused microwaves are directed away from the position of the reflection diffusion apparatus toward the inside of the oven in order to reduce reflected waves and facilitate heating matching.

In any of these methods, the oven may be provided with a plurality of microwave introduction ports arranged at opposing positions to enable uniform heating in order to reduce reflected waves and facilitate heating matching.

Another method of heating objects with microwaves according to the present invention comprises the steps of passing microwaves emitted from a microwave generator toward an oven through a propagation path shaped so as to not hinder the propagation of microwaves incident toward the oven, and shaped so to make the cross-sectional area of the oven side port portion of the propagation path larger than the cross-sectional area of the microwave generator side port portion of the propagation path, wherein a microwave reflector apparatus is provided at a prescribed position inside the propagation path to reflect most of the reflected microwaves from the oven heading toward the microwave generator back into the oven; passing the microwaves incident toward the oven through a straight metal tube having a prescribed length and port portions having the same size and shape as the oven side port portion of the propagation path; and passing the microwaves incident toward the oven through a microwave introduction port into the oven, wherein the oven is provided with a metal reflection diffusion apparatus arranged at a prescribed position in front of the microwave introduction port at a prescribed distance therefrom, whereby a prescribed ratio of the microwaves incident into the oven undergo reflection diffusion, wherein the major portion of the reflection diffused microwaves are directed away from the position of the reflection diffusion apparatus toward the inside of the oven in order to reduce reflected waves and facilitate heating matching.

Further, another method of heating objects with microwaves according to the present invention comprises the steps of passing microwaves emitted from a microwave generator toward an oven through a propagation path shaped so as to not hinder the propagation of microwaves incident toward the oven, and shaped so to make the cross-sectional area of the oven side port portion of the propagation path larger than the cross-sectional area of the microwave generator side port portion of the propagation path, wherein a microwave reflector apparatus is provided at a prescribed position inside the propagation path to reflect most of the reflected microwaves from the oven heading toward the microwave generator back into the oven; passing the microwaves incident toward the oven through a straight metal tube having a prescribed length and port portions having the same size and shape as the oven side port portion of the propagation path; and passing the microwaves incident toward the oven through a microwave introduction port into the oven, wherein the oven is provided with a metal reflection diffusion apparatus arranged at a prescribed position in front of the microwave introduction port at a prescribed distance therefrom, whereby a prescribed ratio of the microwaves incident into the oven undergo reflection diffusion, wherein the major portion of the reflection diffused microwaves are directed away from the position of the reflection diffusion apparatus toward the inside of the oven in order to reduce reflected waves and facilitate heating matching; wherein the oven is provided with a plurality of microwave introduction ports arranged at opposing positions to enable uniform heating in order to reduce reflected waves and facilitate heating matching.

One apparatus for heating objects with microwaves according to the present invention includes a microwave generator; an oven; a waveguide having one port portion connected to the microwave generator and one port portion connected to the oven, with the waveguide being shaped so as to not hinder the propagation of microwaves incident toward the oven, and shaped so to make the cross-sectional area of the oven side port portion of the waveguide larger than the cross-sectional area of the microwave generator side port portion of the waveguide; and a microwave reflector apparatus provided inside the waveguide at a prescribed position to reflect most of the reflected microwaves from the oven heading toward the microwave generator back into the oven, with the microwave reflector being shaped in the form of a prescribed size cone, pyramid, bell or other similar shape whose base is arranged to face the oven so as to not hinder the propagation of microwaves incident toward the oven.

Further, the microwave heating apparatus of may further include a microwave introduction port formed in the oven; and a straight metal tube having a prescribed length and port portions having the same size and shape as the oven side port portion of the waveguide, with the straight metal tube being connected to the microwave introduction port of the oven.

Further, the straight metal tube of the microwave heating apparatus a may be integrally formed with the microwave introduction port of the oven.

Another apparatus for heating objects with microwaves according to the present invention includes a microwave generator an oven; a microwave introduction port formed in the oven; and a fixed metal reflection diffusion apparatus arranged in the oven at a prescribed position in front of the microwave introduction port at a prescribed distance therefrom, whereby a prescribed ratio of the microwaves incident into the oven undergo reflection diffusion, wherein the major portion of the reflection diffused microwaves are directed away from the position of the reflection diffusion apparatus toward the inside of the oven.

As one example, the fixed metal reflection diffusion apparatus may be formed with a plurality of V-shaped or U-shaped blades having a prescribed length and width radiating out from a central portion, with the reflection diffusion apparatus being arranged so that the vertex line side of the blades faces the microwave introduction port of the oven.

As another example, the fixed metal reflection diffusion apparatus may be formed as a prescribed size cone, bell, pyramid or other similar shape, with the reflection diffusion apparatus being arranged so that the vertex side thereof faces the microwave introduction port of the oven.

Further, any of these microwave heating apparatuses may include a plurality of microwave introduction ports formed in the oven at opposing positions to produce uniform heating.

Another apparatus for heating objects with microwaves according to the present invention includes a microwave generator; an oven; a microwave introduction port formed in the oven; a waveguide having one port portion connected to the microwave generator and one port portion connected to the oven, the waveguide being shaped so as to not hinder the propagation of microwaves incident toward the oven, and shaped so to make the cross-sectional area of the oven side port portion of the waveguide larger than the cross-sectional area of the microwave generator side port portion of the waveguide; a microwave reflector apparatus provided inside the waveguide at a prescribed position to reflect most of the reflected microwaves from the oven heading toward the microwave generator back into the oven, the microwave reflector being shaped in the form of a prescribed size cone, pyramid, bell or other similar shape whose base is arranged to face the oven so as to not hinder the propagation of microwaves incident toward the oven; a straight metal tube having a prescribed length and port portions having the same size and shape as the oven side port portion of the waveguide, with the straight metal tube being connected to the microwave introduction port of the oven or forming an integral part of the microwave introduction port; and a fixed metal reflection diffusion apparatus arranged in the oven at a prescribed position in front of the microwave introduction port at a prescribed distance therefrom, whereby a prescribed ratio of the microwaves incident into the oven undergo reflection diffusion, with the major portion of the reflection diffused microwaves being directed away from the position of the reflection diffusion apparatus toward the inside of the oven.

Still another apparatus for heating objects with microwaves according to the present invention includes a microwave generator; an oven; a plurality of microwave introduction ports formed in the oven at opposing positions to produce uniform heating; at least one waveguide having one port portion connected to the microwave generator and one port portion connected to the oven, the waveguide being shaped so as to not hinder the propagation of microwaves incident toward the oven, and shaped so to make the cross-sectional area of the oven side port portion of the waveguide larger than the cross-sectional area of the microwave generator side port portion of the waveguide; at least one microwave reflector apparatus provided inside the waveguide at a prescribed position to reflect most of the reflected microwaves from the oven heading toward the microwave generator back into the oven, the microwave reflector being shaped in the form of a prescribed size cone, pyramid, bell or other similar shape whose base is arranged to face the oven so as to not hinder the propagation of microwaves incident toward the oven; at least one straight metal tube having a prescribed length and port portions having the same size and shape as the oven side port portion of the waveguide, with the straight metal tube being connected to at least one microwave introduction port of the oven or forming an integral part of at least one microwave introduction port; and at least one fixed metal reflection diffusion apparatus arranged in the oven at a prescribed position in front of at least one microwave introduction port at a prescribed distance therefrom, whereby a prescribed ratio of the microwaves incident into the oven undergo reflection diffusion, with the major portion of the reflection diffused microwaves being directed away from the position of the reflection diffusion apparatus toward the inside of the oven.

Reference Numbers/Characters

1 Oven

Figure 1:
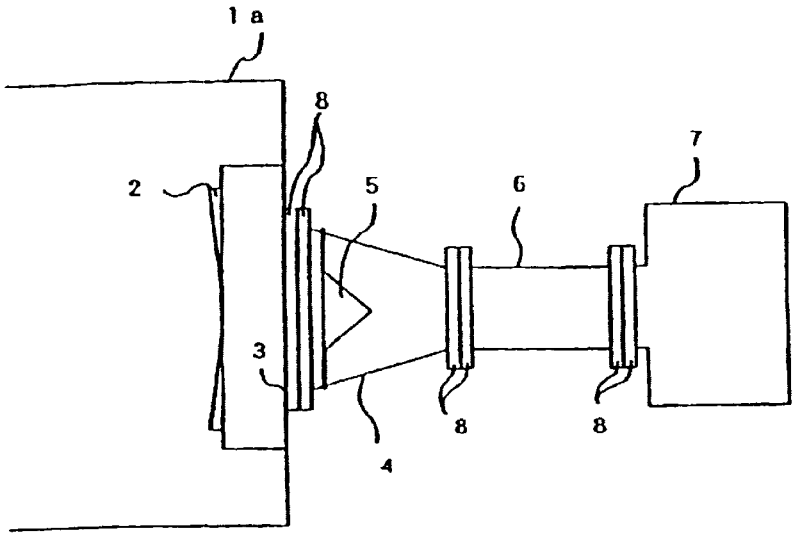
FIG. 1(*a*) is an outline explanatory drawing showing an embodiment of the present invention for the case where a reflector apparatus is provided inside the waveguide, FIG. 1(*b*) and 1(*c*) show the case where the waveguide is provided with a straight tube, and FIG. 1(*d*) is an outline explanatory drawing showing the case where the straight tube is formed as an integral part of the oven.
Figure 1:
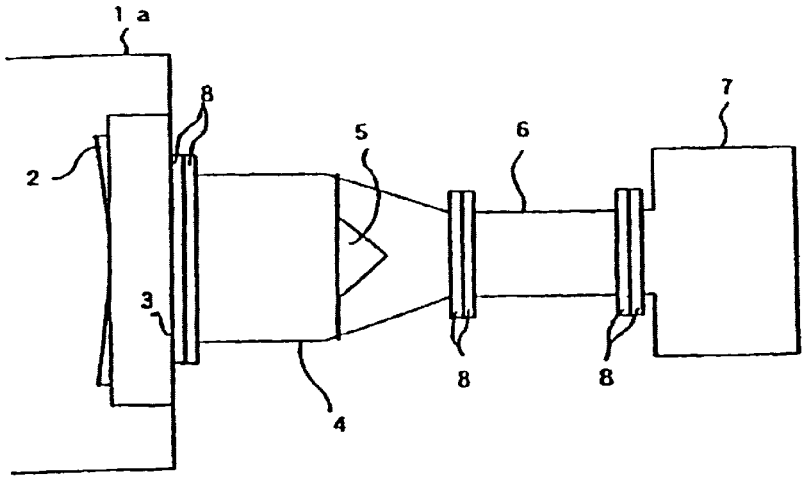
Figure 1:
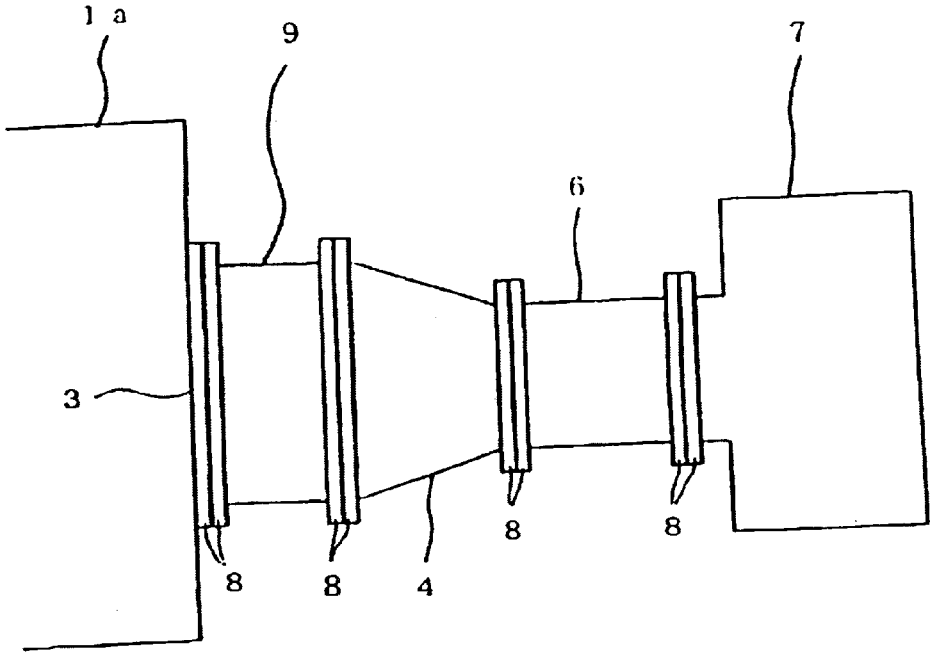
Figure 1:
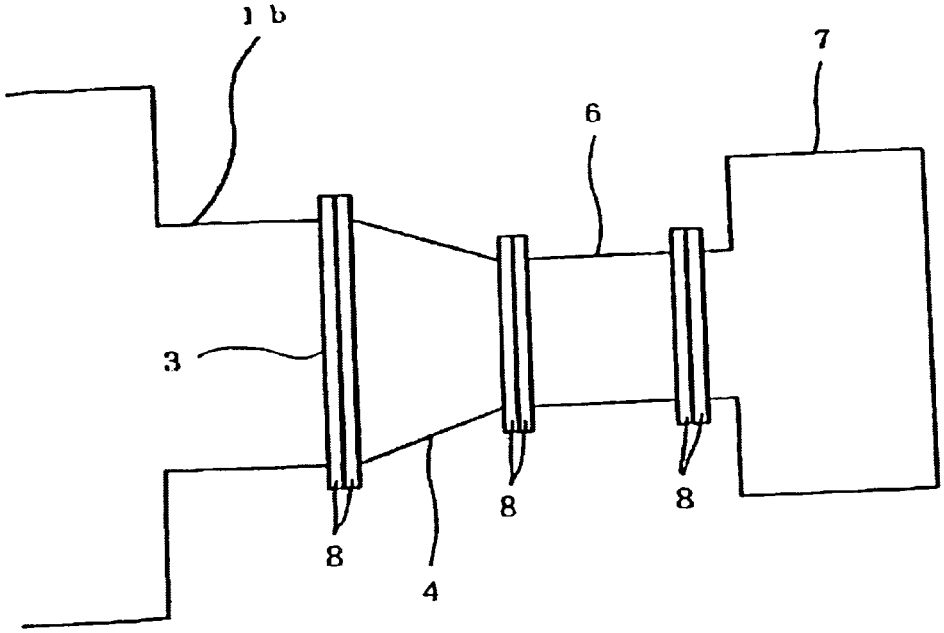
Figure 2:
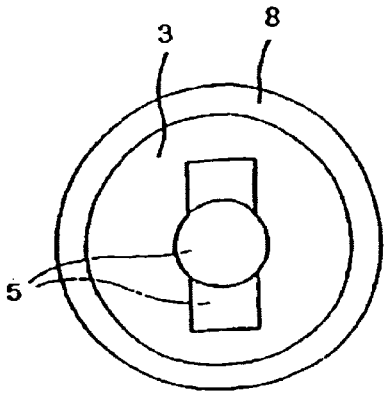
FIG. 2(*a*) is a front view showing an example waveguide shape and an example arrangement of a reflector apparatus provided inside the waveguide, FIG. 2(*b*) is a cross-sectional side view of the example shown in FIG. 2(*a*), FIG. 2(*c*) is a front view showing another example waveguide shape and another example arrangement of a reflector apparatus provided inside the waveguide, and FIG. 2(*d*) is a cross-sectional side view of the example shown in FIG. 2(*c*).
Figure 2:
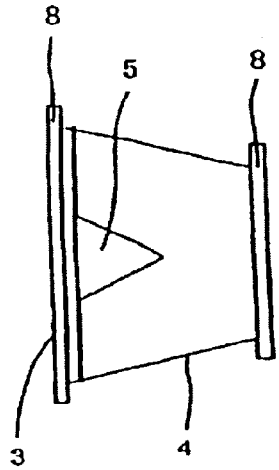
Figure 2:
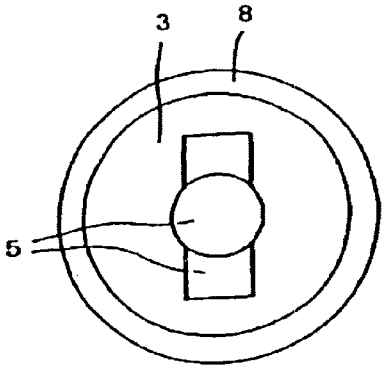
Figure 2:
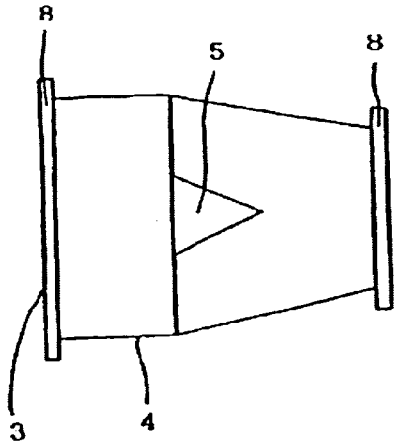
Figure 3:
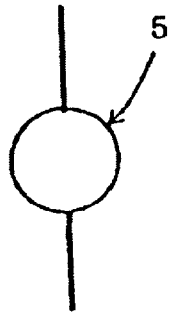
FIG. 3(*a*) is a front outline view of an example shape of the reflector apparatus provided inside the waveguide, FIG. 3(*b*) is a side outline view of the example shown in FIG. 3(*a*), FIG. 3(*c*) is a front outline view of another example shape of the reflector apparatus provided inside the waveguide, and FIG. 3(*d*) is a side outline view of the example shown in FIG. 3(*c*).
Figure 3:
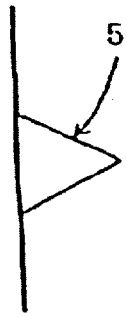
Figure 3:
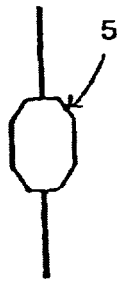
Figure 3:
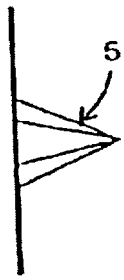
Figure 4:
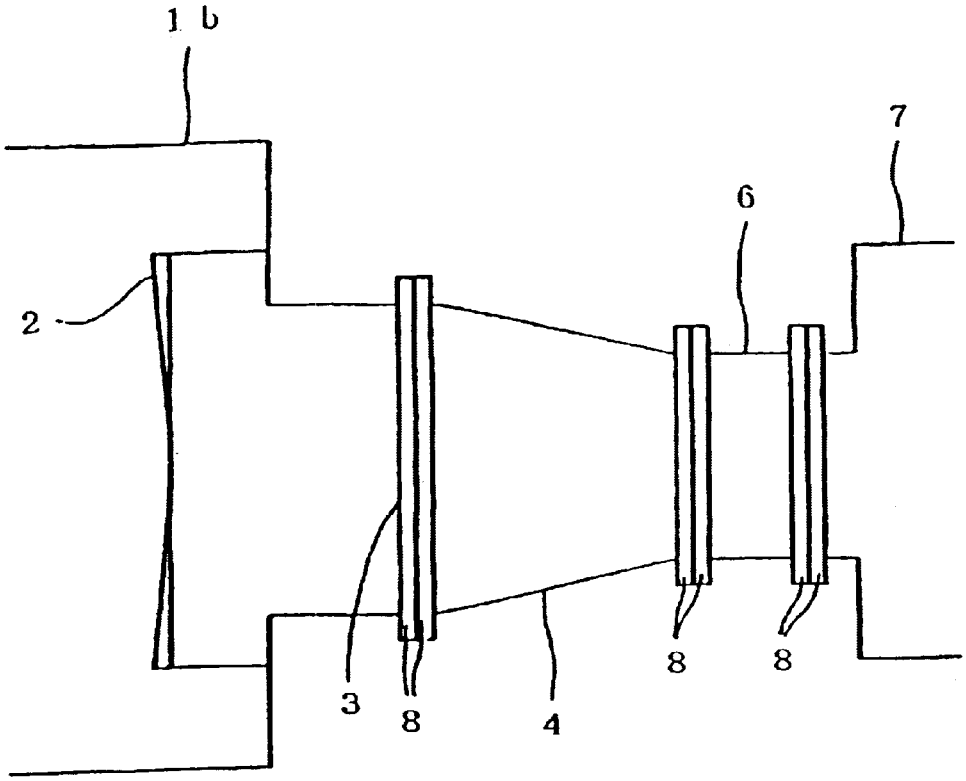
FIG. 4 is an outline explanatory drawing showing an example arrangement of a fixed metal microwave reflection diffusion apparatus provided in the oven.
Figure 5:
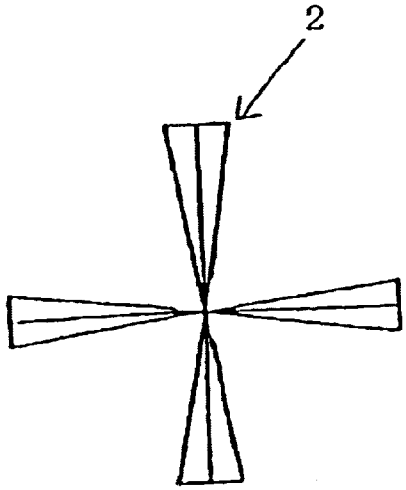
FIG. 5(*a*) is a front outline view showing one example of a blade-type reflection diffusion apparatus, FIG. 5(*b*) is a side outline view of the example shown in FIG. 5(*a*), and FIG. 5(*c*) is a partial perspective view of the blade-type reflection diffusion apparatus.
Figure 5:
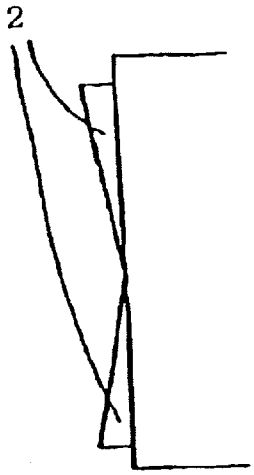
Figure 5:
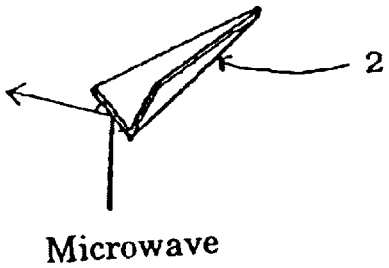
Figure 6:
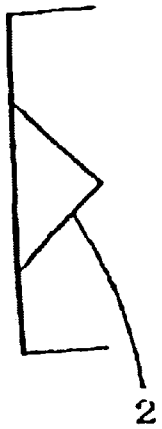
FIG. 6(*a*) is an outline explanatory drawing showing one example of a cone-type reflection diffusion apparatus, FIG. 6(*b*) is an outline explanatory drawing showing one example of a bell-type reflection diffusion apparatus, and FIG. 6(*c*) is an outline explanatory drawing showing one example of a pyramid-type reflection diffusion apparatus.
Figure 6:
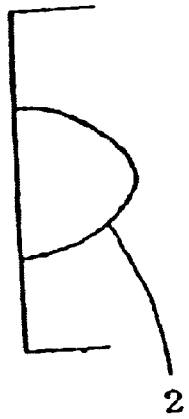
Figure 6:
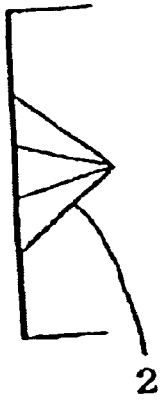
Figure 7:
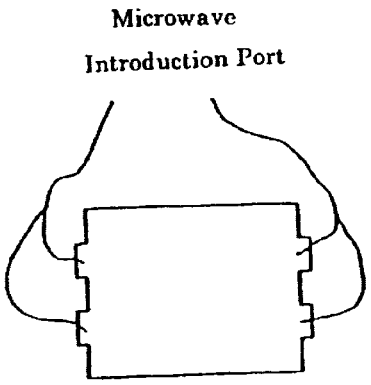
FIG. 7(*a*) is a front view showing an example arrangement in which a plurality of microwave introduction ports are provided at opposing positions in the oven, FIG. 7(*b*) is a side view of the example shown in FIG. 7(*a*), and FIG. 7(*c*) is a side view of the example shown in FIG. 7(*a*).
Figure 7:
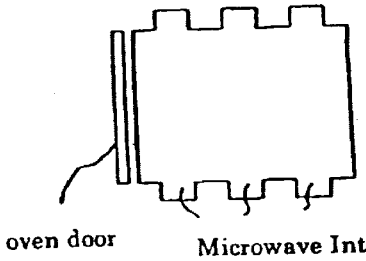
Figure 7:
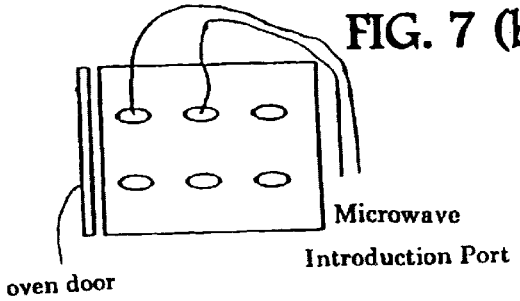
Figure 8:
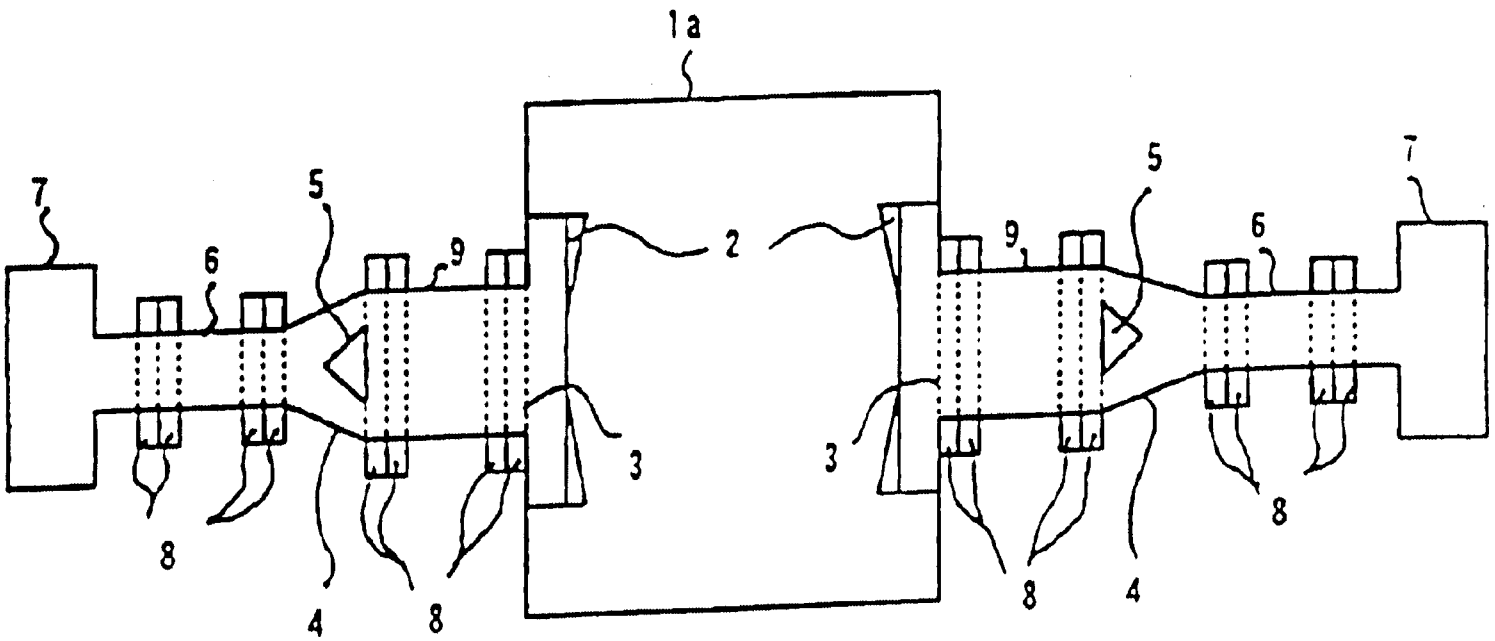
FIG. 8 is an outline explanatory drawing showing an example assembled structure.

1*a* Oven including flange for introduction port

1*b* Oven including straight tube for introduction port

2 Fixed microwave reflection diffusion apparatus provided in oven

3 Microwave introduction port

4 Waveguide connected to microwave introduction port (or straight tube of claim 9)

5 Microwave reflector apparatus provided at prescribed position inside waveguide 4

Waveguide

Microwave generator

8 Connection flange

9 Straight tube connected to microwave introduction port and waveguide 4

DETAILED DESCRIPTION OF THE PREFERRED EMBODIMENTS

OPERATION

Most of the reflected waves which result in microwave energy loss are generated inside the waveguide or by microwaves introduced into the oven flowing back into the waveguide from a microwave introduction port. This problem arises when the waveguide connected to the oven has a structure that produces reflected waves or a structure that makes it easy for microwaves to flow back into the waveguide from the oven, or when the overall matching of the heating system is bad. Accordingly, to make it possible for roughly all the microwaves to be passed into the oven, the waveguide connected to the oven needs to at least have a structure that does not hinder the flow of microwaves into the oven. Further, a mechanism which includes a nonreturn valve function to prevent reflected microwaves in the oven from flowing back into the waveguide needs to be provided, and at the same time the heating matching which forms the most important factor needs to be significantly improved.

It has been determined by experiment that in order for most of the microwaves generated from the microwave generator to flow into the oven, it is important to prevent reflected waves from being generated inside the waveguide connected to the oven. Further, from examinations of the cross-sectional areas of the waveguide up to the microwave introduction port in the oven, a comparison of all points along the waveguide revealed that the cross-sectional area of the waveguide at positions toward the oven side must no be smaller that the cross-sectional area of the wave guide at positions toward the microwave generator side. Further, it was confirmed that so long as the cross-sectional area of the waveguide at positions toward the microwave generator side, the shape of the waveguide will not cause reflected waves to be generated. Accordingly, the waveguide connected to the oven can have a shape which does not change from the microwave generator to the oven, or a shape which has an expanding cross-sectional area near the oven. However, this does not make it possible to prevent reflected microwaves for flowing back into the waveguide from the oven.

In response to this, the waveguide connected to the oven is shaped like a horn or the like by making the cross-sectional area of the port portion at the oven side greater than the cross-sectional area of the port portion at the microwave generator side, and a reflector apparatus made of metal and having a cone shape, pyramid shape, bell shape or other similar shape is provided inside the waveguide with the bottom of the reflector apparatus facing the oven side in order to function as a nonreturn valve which prevents reflected microwaves from entering the waveguide from the oven.

In order to avoid hindering the flow of microwaves into the oven from the microwave generator, the relationship between the reflector apparatus provided in the waveguide and the shape and size of the waveguide must be carefully considered because any inappropriate combination will make it impossible to reduce reflected waves. For example, in the case where the reflector apparatus has an inappropriate size, shape or mounting position, or in the case where the waveguide has an inappropriate size or shape with respect to the relationship with the reflector apparatus, a convergence will arise in the microwaves, and this will cause reflected waves to be generated in the area of the reflector apparatus.

On the other hand, when an appropriate size, shape and mounting position where selected for the reflector apparatus, it was confirmed by a power monitor that the reflector apparatus functioned as a nonreturn valve in preventing microwaves from flowing back into the waveguide from the oven. In this regard, even when the bottom of the reflector apparatus is flat or hollow, the reflected microwaves from the oven are sufficiently reflected, and so long as the bottom of the reflector apparatus is shaped so as to return microwaves for reapplication, there are no restrictions on shape.

From the results of conducted experiments, the preferred balance between the waveguide connected to the oven and the reflector apparatus provided inside the waveguide was obtained, and it was determined that is was possible to achieve a significant reduction in reflected waves. Further, from experiments comparing heating efficiencies, it was determined that the structure according to the present invention achieved a significant improvement in heating matching.

Further, for the case where a straight tube was provided between the oven and the waveguide, measurements of heating efficiency confirmed further improvement in heating matching. The reason for this is that the straight tube acts as a matching device, and this improves the matching of the microwaves flowing from the microwave generator through the waveguide into the oven and the reflected waves from the oven that have been reflected again by the reflector apparatus. The straight tube can be formed as an integral portion of the waveguide or as an integral portion of the oven. In either case, the straight tube needs to be provided in the propagation path along which the microwaves from the generator are propagated to the oven.

Now, in the prior art, a stirrer is generally used as a microwave dispersion apparatus, but such rotational dispersion does not necessarily achieve a sufficient improvement in heating matching. In particular, it has been determined from experiments that scorching can occur at specific locations even when a rotational dispersion is carried out with a stirrer, and this is due to the fact that such dispersion is not carried out at random. Namely, such rotational dispersion merely creates a fixed flow of microwaves. Further, fluctuations in the amount of energy of both the incident waves and the reflected waves were observed at the stirrer, and this had an effect on fine heating matching. Further, because the stirrer requires a lot of space inside the oven for holding a rotation apparatus, there are many cases where the use of a stirrer hinders the ability to achieve heating matching by the provision of many microwave introduction ports.

In this connection, a reflection diffusion apparatus was invented to replace the stirrer. Namely, a fixed reflection diffusion apparatus made of metal is provided. This reflection diffusion apparatus is shaped so as to make it possible for a prescribed ratio of microwaves incident into the oven to undergo reflection diffusion inside the oven. Further, because the reflection diffusion apparatus is shaped so as to make it possible for the major portion of the reflection diffused microwaves to be guided toward the inside of the oven from the position of the reflection diffusion apparatus in the oven, the reflection diffusion apparatus is provided at a position in front of the microwave introduction port at a prescribed distance from the microwave introduction port. In this connection, experiments were repeatedly carried out to find the distance from the microwave introduction port, the ratio of incident microwaves diffused and the shape of the reflection diffusion apparatus, and from the results of such experiments, reflection diffusion apparatuses were developed having a windmill shape and a cone shape, bell shape, pyramid shape and other similar shapes.

Further, a fixed reflection diffusion apparatus having a prescribed reflection diffusion ratio with respect to the incident microwaves was provided in an oven at a prescribed appropriate distance from the microwave introduction port, and then from experiments with this arrangement, it was determined that there was a significant reduction in reflected waves and that the microwave heating caused no scorching of the object being heated. In other words, these experiments showed that the heating matching improvement achieved by the reflection diffusion apparatus according to the present invention was more significant than that obtained with a stirrer.

Further, for the case of a fixed reflection diffusion apparatus, no fluctuations in the amount of energy of both the incident microwaves and the reflected waves were observed to occur, and this contributed to the improvement in heating matching.

Further, because the reflection diffusion apparatus is small, it does not become a hindrance in the case where heating matching is to be carried out by providing many microwave introduction ports.

Now, in the case where a plurality of microwave introduction ports are provided in the oven, even when they are provided at opposing positions, because a reflector apparatus is provided inside each waveguide connected to the oven, the interference created between mutually facing microwave introduction ports will prevent and increase in reflected waves. Also, as a comparison, it was confirmed that microwave introduction ports provided at opposing positions achieved a higher heating matching than the case where microwave introduction ports were provided at positions not facing each other. Further, examinations of reflected waves and heating matching were carried out for a system incorporating the subject matter of the present invention, and the following results were obtained. First, from a heating experiment carried out using a stirrer in a prior art system, the occurrence of reflected microwaves was recorded at the high rate of 25% with respect to the incident waves. In contrast with this, experiments revealed that the systems of the present invention recorded an 8% occurrence rate, and the systems of the present invention also recorded a 3% occurrence rate. Furthermore, the systems according to the present invention were able to reach a specific temperature within a shorter heating time, and this shows an improvement in heating matching. Moreover, in the case of heating for the purpose of drying, the present invention makes it possible to eliminate the scorching of the object being heated that occurs in prior art system due to uneven heating, and in the case of heating for the purpose of thawing, the present invention makes it possible to prevent dripping that occurs in prior art thawing systems due to uneven heating.

Specific Embodiment 1

Two ovens having a width of 500 mm, a height of 500 mm and a depth of 600 mm were prepared, and then various comparisons were carried out without the use of a matching device for either oven. First, using a microwave power monitor to carry out measurements, a comparison was made between the reflected waves for the case where a square waveguide was connected to the oven without alteration, and the reflected waves for the case where the waveguide connected to the oven was given a horn shape and a conical metal reflector apparatus having a cone shape (with a base diameter of 75 mm and a height of 80 mm) that matched the shape inside the waveguide at the oven side was provided inside the waveguide at a position 8 mm from the port portion at the oven side with the bottom of the cone shape facing the oven side. At that time, the square-shaped waveguide that was used had an port portion measuring 55 mm×110 mm, and the oven-side port portion of the horn-shaped waveguide was circular with a diameter of 130 mm. Also at that time, the square-shaped waveguide described above was connected to the horn-shaped waveguide at the microwave generator side. In carrying out tests, a 1.5 kW output was used for the microwave generator to operate the system as a drying apparatus, and 2 kg of towels adjusted to have a water content of 75% were used as objects to be dried. In this case, a stirrer was provided inside both ovens. First, in the case where the square-shaped waveguide was connected without alteration to one of the ovens, reflected waves at a level of 0.40 to 0.45 kW were measured for the 1.5 kW microwave output. In contrast with this, in the case where the waveguide connected to the other oven was given a horn shape as described above, with a conical reflector apparatus being provided inside the horn-shaped waveguide, reflected waves at a level of 0.15 to 0.25 kW were measured for the 1.5 kW microwave output.

Specific Embodiment 2

Next, under the same conditions described in Specific Embodiment 1, reflected waves were examined for the case where the straight tube was connected between the oven and the horn-shaped waveguide described in Specific Embodiment 1. The results of such examination confirmed a reduction of reflected waves to a level of 0.12 to 0.15 kW. Further, an experiment was carried out for the case where the microwave introduction port of the oven was shaped as a regular octagon, where the oven-side port portion of the horn-shaped waveguide had the same regular octagon shape as the octagonal microwave introduction port, and where a regular 8-sided pyramid reflector apparatus was provided inside the waveguide at the same position as that described in Specific Embodiment 1, and the measured reflected waves showed that roughly the same results as those described above were obtained.

Specific Embodiment 3

Under the same condition described in Specific Embodiment 2, the windmill-shaped reflection diffusion apparatus of claim 11 was provided in the oven in place of the stirrer. This windmill-shaped reflection diffusion apparatus had 8 vanes which were 240 mm long and V-shaped, with the base of the V having a width of 20 mm, the angle of the V being 90, and the vertex line of the V facing toward the microwave introduction port at a distance of 80 mm therefrom. When measurements of reflected microwaves were carried out during heating, a reflection wave level of 0.05 kW was recorded. This corresponds to a reflectance of approximately 3% for the case of and incident wave output level of 1.5kW. In this regard, because the reflectance can be called a microwave loss ratio, such results indicate that and extremely efficient heating matching was achieved. As a comparison, it should be noted that in the experiment where the horn-shaped waveguide of Specific Embodiment 1 was connected to the oven, the reflectance could not be reduced below 4% even in the case where a matching device was provided near the microwave generator. Next, under the same conditions, an experiment was carried out to measure the reflected microwaves for the case where the bell-shaped reflection diffusion apparatus was arranged in the oven with the vertex facing the microwave introduction port. This bell-shaped reflection diffusion apparatus had an 80 mm diameter bottom and a height of 60 mm, and measurements recorded reflected waves at a level of 0.07 kW.

Specific Embodiment 4

Under the same conditions described in Specific Embodiment 3, measurements of reflected waves were carried out for the case where two microwave introduction ports were provided at opposing positions in the oven. In this case, the reflected microwaves were further reduced to a level of 0.02 kW. These results indicate that it is possible to achieve further improvements in heating matching with an arrangement in which microwaves at an output level of 1.5 kW are divided by a branched waveguide for introduction into the oven via two microwave introduction ports. Further, the towel drying time was determined to be shorter for the case of two microwave introduction ports. Also, an examination of thermal readings taken at various points inside the drying objects recorded the highest error for the temperature attained by heating to be only 3 C. Accordingly, these results confirm that a highly accurate uniform heating can be carried out without the need for the provision of a matching device, and because there is a very low level of reflected waves, there is no need for the provision of an isolator.

EFFECT OF THE PRESENT INVENTION

Up to now, apparatuses that use microwaves have been slow to spread to industrial applications outside microwave ovens. One of the main reasons for this has been the huge cost of providing an isolator and a matching device. Namely, in the prior art, an isolator and a matching device are required to obtain a high heating efficiency without damaging the magnetron. In response to this problem, the present invention makes it possible to greatly reduce the construction cost of the apparatus, and at the same time, the high level of heating matching achieved by the present invention makes it possible to produce high quality products at low cost.

In the present invention, it is possible to start operations the instant the apparatus is turned ON and suspend operations the instant the apparatus is turned OFF, and because the inside of objects can be efficiently heated, such efficient use of energy makes it possible to apply the present invention to a wide variety of industrial fields, including the fields of drying, concentrating, sterilizing, roasting, thawing and the like.

What is claimed is:

1. An apparatus for heating objects with microwaves comprising:

a microwave generator;

an oven;

a waveguide having one port portion connected to the microwave generator and one port portion connected to the oven, the waveguide being shaped so as to not hinder the propagation of microwaves incident toward the oven, and shaped so to make the cross-sectional area of the oven side port portion of the waveguide larger that the cross-sectional area of the microwave generator side port portion of the waveguide; and a microwave reflector apparatus provided inside the waveguide at a prescribed position to reflect most of the reflected microwaves from the oven heading toward the microwave generator back into the oven, the microwave reflector being shaped in the form of a prescribed size cone shape, pyramid shape or bell shape whose base is arranged to face the oven so as to not hinder the propagation of microwaves incident toward the oven.

2. The microwave heating apparatus of claim 1, further comprising:

a microwave introduction port formed in the oven; and a straight metal tube having a prescribed length and port portions having the same size and shape as the oven side port portion of the waveguide, the straight metal tube being connected to the microwave introduction port of the oven.

3. The microwave heating apparatus of claim 2, wherein the straight metal tube is integrally formed with the microwave introduction port of the oven.

4. An apparatus for heating objects with microwaves, comprising:

a microwave generator;

an oven;

a waveguide having one port portion connected to the microwave generator and one port portion connected to the oven, the waveguide being shaped so as to not hinder the propagation of microwaves incident toward the oven, and shaped so to make the cross-sectional area of the oven side port portion of the waveguide larger than the cross-sectional area of the microwave generator side port portion of the waveguide;

a microwave reflector apparatus provided inside the waveguide at a prescribed position to reflect most of the reflected microwaves from the oven heading toward the microwave generator back into the oven, the microwave reflector being shaped in the form of a prescribed size cone shape, pyramid shape or bell shape whose base is arranged to face the oven so as to not hinder the propagation of microwaves incident toward the oven;

a straight metal tube having a prescribed length and port portions having the same size and shape as the oven side port portion of the waveguide, the straight metal tube being connected to the microwave introduction port of the oven or forming an integral part of the microwave introduction port; and a fixed metal reflection diffusion apparatus arranged in the oven at a prescribed position in front of the microwave introduction port at a prescribed distance therefrom, whereby a prescribed ratio of the microwave incident into the oven undergo reflection diffusion, wherein the major portion of the reflection diffused microwaves are directed away from the position of the reflection diffusion apparatus toward the inside of the oven.

5. An apparatus for heating objects with microwaves comprising:

a microwave generator;

an oven;

a plurality of microwave introduction ports formed in the oven at opposing position to produce uniform heating;

at least one waveguide having and one port portion connected to the microwave generator and one port portion connected to the oven, the waveguide being shaped so as to not hinder the propagation of microwaves incident toward the oven, and shaped so to make the cross-sectional area of the oven side port portion of the waveguide larger that the cross-sectional area of the microwave generator side port portion of the waveguide;

at least one microwave reflector apparatus provided inside the waveguide at a prescribed position to reflect most of the reflected microwaves from the oven heading toward the microwave generator back into the oven, the microwave reflector being shaped in the form of a prescribed size cone shape, pyramid shape or bell shape whose base is arranged to face the oven so as to not hinder the propagation of microwaves incident toward the oven;

at least one straight metal tube having a prescribed length and port portions having the same size and shape as the oven side port portion of the waveguide, the straight metal tube being connected to the microwave introduction port of the oven or forming an integral part of the microwave introduction port; and at least one fixed metal reflection diffusion apparatus arranged in the oven at a prescribed position in front of at least one microwave introduction port at a prescribed distance therefrom, whereby a prescribed ratio of the microwave incident into the oven undergo reflection diffusion, wherein the major portion of the reflection diffused microwaves are directed away from the position of the reflection diffusion apparatus toward the inside of the oven.

* * * * *